US011702864B2

(12) United States Patent
Berger et al.

(10) Patent No.: US 11,702,864 B2
(45) Date of Patent: Jul. 18, 2023

(54) AUTOMATIC LOCKING-DEADBOLT ASSEMBLY IN A DOOR

(71) Applicant: Securitech Group, Inc., Maspeth, NY (US)

(72) Inventors: Simon Berger, Long Beach, NY (US); Krzysztof Marciniec, Glendale, NY (US)

(73) Assignee: SECURITECH GROUP, INC., Maspeth, NY (US)

( * ) Notice: Subject to any disclaimer, the term of this patent is extended or adjusted under 35 U.S.C. 154(b) by 220 days.

(21) Appl. No.: 16/299,664

(22) Filed: Mar. 12, 2019

(65) Prior Publication Data

US 2019/0277064 A1 Sep. 12, 2019

Related U.S. Application Data

(60) Provisional application No. 62/641,746, filed on Mar. 12, 2018.

(51) Int. Cl.

| | |
|---|---|
| ***E05B 63/20*** | (2006.01) |
| ***E05B 55/12*** | (2006.01) |
| ***E05B 63/00*** | (2006.01) |
| ***E05B 59/00*** | (2006.01) |
| ***E05B 17/20*** | (2006.01) |

(52) U.S. Cl.

CPC ..... *E05B 63/20* (2013.01); *E05B 17/2007* (2013.01); *E05B 17/2053* (2013.01); *E05B 55/12* (2013.01); *E05B 59/00* (2013.01); *E05B 63/0056* (2013.01); *E05B 2063/207* (2013.01); *E05Y 2900/132* (2013.01)

(58) Field of Classification Search

CPC ..... E05B 17/2007; E05B 17/2015; E05B 17/2019; E05B 17/2049; E05B 17/2053; E05B 17/2069; E05B 17/2073; E05B 55/00; E05B 55/12; E05B 59/00; E05B 63/0056; E05B 63/14; E05B 63/20; E05B 63/202; E05B 63/205; E05B 2063/207

See application file for complete search history.

(56) References Cited

U.S. PATENT DOCUMENTS 1,674,760 A * 6/1928 Carroll ..... E05B 65/1013 292/DIG. 68
2,710,216 A * 6/1955 Eichacker ..... E05B 65/1013 74/110

(Continued)

FOREIGN PATENT DOCUMENTS

FR 2965002 A1 * 3/2012 ..... E05B 63/20

*Primary Examiner* — Christopher J Boswell
(74) *Attorney, Agent, or Firm* — Amster Rothstein & Ebenstein LLP

(57) ABSTRACT

A lock assembly for a door includes a lock body having a housing with at least one deadbolt supported in the housing for movement between a retracted position and an extended position and biased toward the extended position by a spring, and a trigger mechanism mounted on the door separate from the lock body for engagement with a door jamb upon closure of the door, said trigger mechanism being adapted to hold the at least one deadbolt in the retracted position when the door is open in opposition to a spring bias, and to permit movement of the at least one deadbolt to the extended position upon engagement of the trigger mechanism with the door jamb.

18 Claims, 16 Drawing Sheets

(56) References Cited

U.S. PATENT DOCUMENTS 2,781,218 A * 2/1957 Jewett ..... E05B 65/1013 292/336
3,123,387 A * 3/1964 Jackson et al. ..... E05B 65/1013 292/2
4,478,444 A * 10/1984 Kurz ..... E05B 63/20 292/333
4,561,684 A * 12/1985 Marotto ..... E05B 63/20 292/1.5
5,373,716 A * 12/1994 MacNeil ..... E05C 9/026 292/165
5,531,492 A * 7/1996 Raskevicius ..... E05B 65/1013 292/335
6,138,485 A * 10/2000 Fuss ..... E05B 47/0676 70/107
6,217,087 B1 * 4/2001 Fuller ..... E05B 63/20 70/108
7,055,871 B2 * 6/2006 Toledo ..... E05B 47/0046 292/144
7,431,354 B2 * 10/2008 Raatikainen ..... E05B 63/20 70/277
7,712,799 B2 * 5/2010 Peng ..... E05B 65/1013 292/156
8,191,937 B2 * 6/2012 Lin ..... E05C 7/06 292/58
8,523,250 B2 * 9/2013 Chen ..... E05C 9/047 292/332
8,979,140 B2 * 3/2015 Tien ..... E05C 7/06 292/92
9,567,782 B2 * 2/2017 Raatikainen ..... E05C 7/06
10,927,571 B2 * 2/2021 Bartholdi ..... E05C 9/02
11,377,887 B2 * 7/2022 Cote ..... E05B 63/20
2020/0199922 A1 * 6/2020 Cote ..... E05B 63/20
2020/0277813 A1 * 9/2020 Schaeffer ..... E05B 63/14
2021/0062544 A1 * 3/2021 Lien ..... E05B 63/20

* cited by examiner

AUTOMATIC LOCKING-DEADBOLT ASSEMBLY IN A DOOR

RELATED APPLICATION

This application claims the priority of U.S. Provisional Application Ser. No. 62/641,746 filed Mar. 12, 2018 pursuant to 35 U.S.C. 119(a)-(d), the content of which is incorporated herein by reference in its entirety as if fully set forth herein.

FIELD OF THE INVENTION

The present invention relates to doors with deadbolts and a lock assembly to control movement of the deadbolts between extended and retracted positions into and out of their respective strike plates. More particularly, the invention relates to doors with deadbolts that automatically extend and lock the door when the door is closed.

BACKGROUND OF THE INVENTION

Deadbolts are designed to lock a door so as to prevent intruders from entering a home, business or other space secured by the door. In contrast to latches, deadbolts are physically blocked from being retracted from their extended position through application of external force and are therefore used in situations where it is desirable for the lock to resist manipulation by a potential intruder. In some circumstances it is desirable for the deadbolt to extend automatically upon closing the door. This ensures that the door is locked by a deadbolt without having to manually extend the deadbolt. Existing automatic deadbolt locks offer a certain degree of security and functionality. However, there exists a need to provide an improved deadbolt lock that is easy to manufacture, install and operate while offering a high degree of security.

SUMMARY OF THE INVENTION

According to one aspect of the present invention a lock assembly for a door includes a lock body having a housing; a first deadbolt supported in the housing for movement between a retracted position and an extended position that is biased toward the extended position by a spring; and a trigger mechanism mounted on the door remote from the lock body for engagement with a door jamb upon closure of the door, the trigger mechanism being adapted to hold the deadbolt in the retracted position when the door is open in opposition to the bias of the spring, and to permit movement of the deadbolt to the extended position upon engagement of the trigger mechanism with the door jamb. The term remote as used in the context of the present invention means that the trigger mechanism is separate from the lock body.

The lock assembly according to the present invention thus enables automatic extension of the deadbolt from the retracted to the extended position upon closure of the door. This is a valuable function in many situations which require constant security, examples including IT server rooms, valuable storage and inventory rooms, building perimeter doors and also in classrooms to secure the classroom against an approaching intruder. This invention provides the valuable function of being able to provide a deadbolt action by merely closing the door and without having to find and maneuver any latch mechanisms or keys to manually extend the deadbolts.

According to another advantageous feature of the invention, the lock assembly further includes a bolt locking arm operatively coupled to the deadbolt and supported in the housing for movement between an unlocked position permitting movement of the deadbolt from the extended position to the retracted position and a locked position preventing movement of the deadbolt from the extended position to the retracted position, wherein movement of the deadbolt from the retracted to the extended position causes pivoting of the bolt locking arm from the unlocked to the locked position.

According to another advantageous feature of the invention, the lock assembly further includes an inner spindle cam rotatably supported in the housing and coupled with the deadbolt and the bolt locking arm so that rearward rotation of the spindle cam with respect to a front side of the housing causes pivoting of the bolt locking arm from the locked to the unlocked position and movement of the deadbolt from the extended to the retracted position.

The inner spindle cam is configured to receive the spindle of an internal door lever so that the spindle cam is rotated by turning the internal door lever. This allows the deadbolt to be released from its locked extended position and retraction of the deadbolt and the opening of the door from the inside by turning the internal door lever.

According to another advantageous feature of the invention, the lock assembly can further include an outer spindle cam rotatably supported in the housing independently of the first spindle cam and coupled to the deadbolt and the bolt locking arm so that rearward rotation of the outer spindle cam with respect to the front side of the housing causes pivoting of the bolt locking arm from the locked to the unlocked position and movement of the deadbolt from the extended to the retracted position.

Providing an outer spindle cam enables release of the deadbolt from its deadlocked condition permitting retraction of the deadbolt and thus opening the door from the outside by turning an external door lever whose spindle is received in the outer spindle cam.

According to another advantageous feature of the invention, the deadbolt lock assembly can include a bolt locking arm actuator pivotally supported in the housing and coupled to the bolt locking arm, the bolt locking arm actuator being adapted to pivot in response to engagement with a cam of a keyed cylinder received in a side wall of the housing to thereby cause pivoting of the bolt locking arm from the locked position to the unlocked position.

In such an embodiment of the invention, the deadlocked condition of the deadbolt can be released by turning the keyed cylinder from the outside with an authorized key.

According to another advantageous feature of the invention, the trigger mechanism includes a base plate and an upper plate connected in spaced apart and parallel relation, a locking plate received between the base plate and the upper plate and pivotable between an upper position and a lower position, and a trigger plate, adapted to cause pivoting of the locking plate from the upper position to the lower position in response to engagement of the trigger plate with the door jamb, said base plate, upper plate and locking plate respectively provided with apertures for slidingly receiving the deadbolt therein, wherein in the upper position of the locking plate the deadbolt is held in the retracted position by engagement with an edge of the aperture of the locking plate and in the lower position of the locking plate movement of the deadbolt through the apertures from the retracted to the extended position is permitted.

According to another advantageous feature of the invention, the lock assembly can include a second deadbolt supported in the housing for movement between a retracted and an extended position in which the first and second deadbolt are coupled for simultaneous movement between their respective retracted and extended positions, and so that movement of the second deadbolt from the retracted to the extended position is blocked when the first deadbolt is held in its retracted position.

According to another advantageous feature of the invention, the lock assembly can include a third deadbolt supported in the housing for movement between a retracted and an extended position, in which the first, second and third deadbolts are coupled for simultaneous movement between their respective retracted and extended positions, and so that movement of the second and third deadbolts from their respective retracted to their extended positions is blocked when the first deadbolt is held in its retracted position.

According to another advantageous feature of the invention, the first, second and third deadbolts are coupled with each other by a gear member rotatably supported in the housing so that rotation of the gear member in a clockwise (CW) direction causes movement of the first, second and third deadbolts from their respective extended positions to their retracted positions and counter-clockwise (CCW) movement of the gear member causes movement of the deadbolts from their respective retracted positions to their extended positions.

BRIEF DESCRIPTION OF THE DRAWINGS

The above and other advantages of the invention will be further described and appreciated by those skilled in the art by reference to the following detailed description of the invention, the claims and the appended drawings in which:

Figure 1:
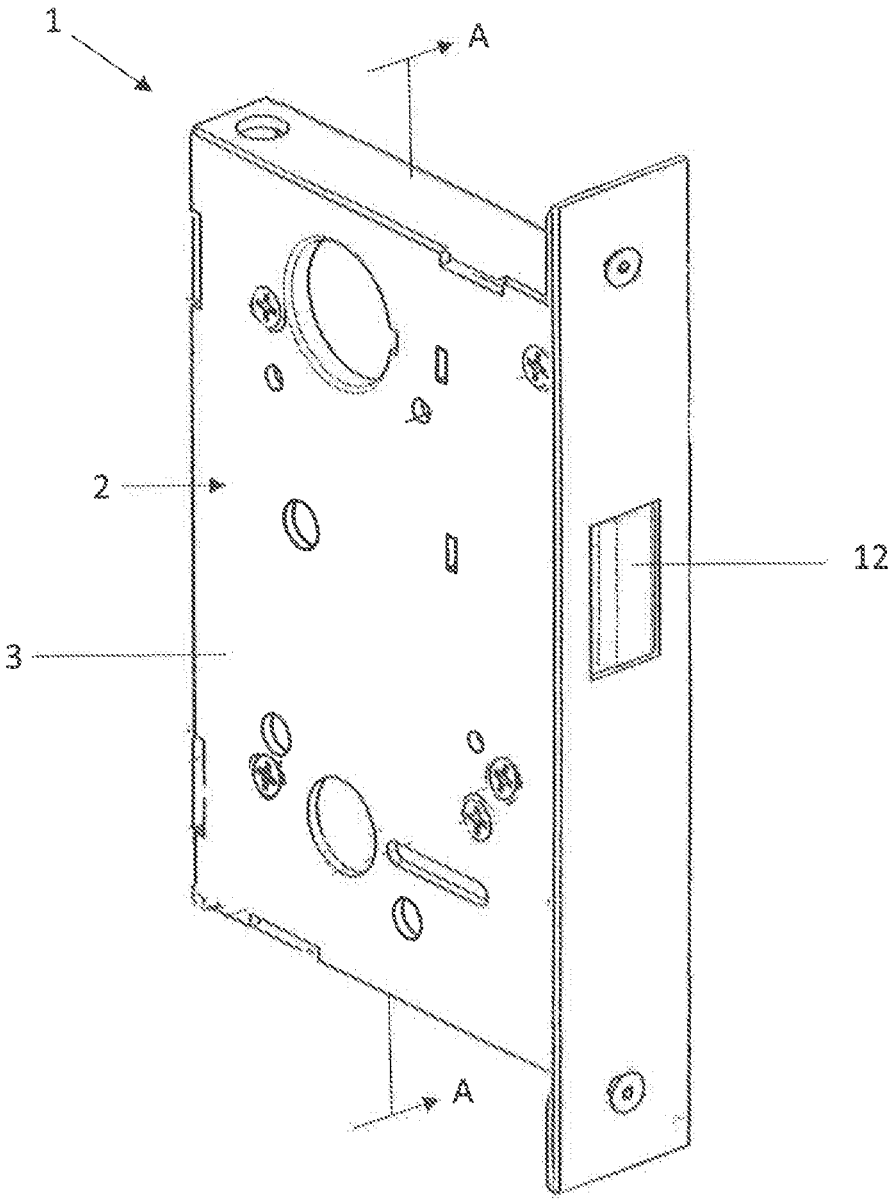
FIG. 1 is a perspective view of the exterior of the lock body of the new locking deadbolt assembly.

Throughout all the Figures, the same or corresponding elements are identified by same reference numeral. The embodiments are to be understood as illustrative of the invention and not as limiting in any way. It will also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive have been omitted.

DETAILED DESCRIPTION OF PREFERRED EMBODIMENTS

Referring to FIG. 1, an embodiment of a lock body of the lock assembly according to the present invention is shown and is generally designated by reference numeral 1. The lock body 1 comprises a housing 2 for housing the lock components. One of the side walls of the housing comprises a cover 3 which forms a closure of the lock body 1.

Figure 2:
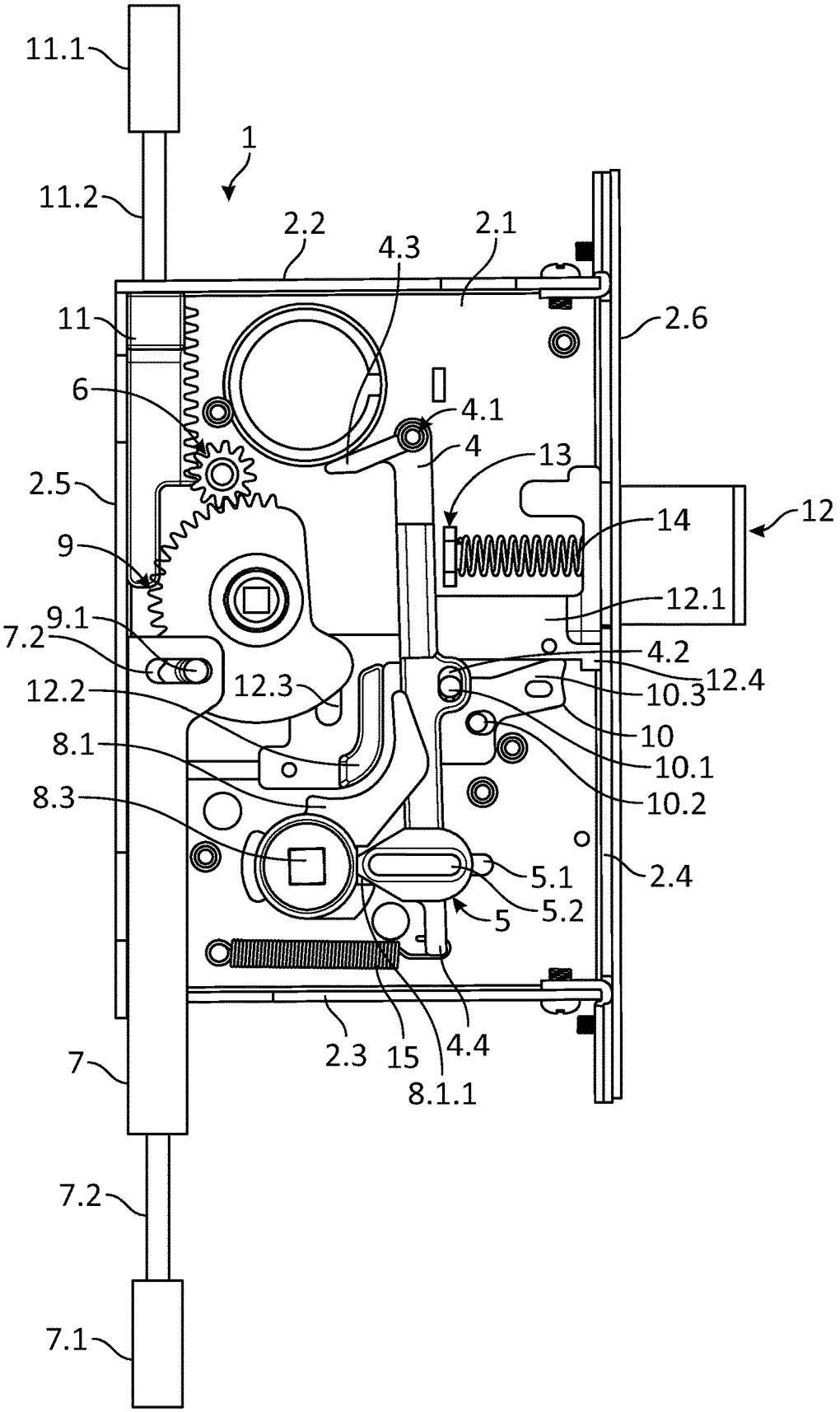
FIG. 2 is a side elevation view of the interior of the new locking deadbolt assembly of FIG. 1 taken along the direction of the arrows A-A with the cover removed and the deadbolts in the extended position.
Figure 3:
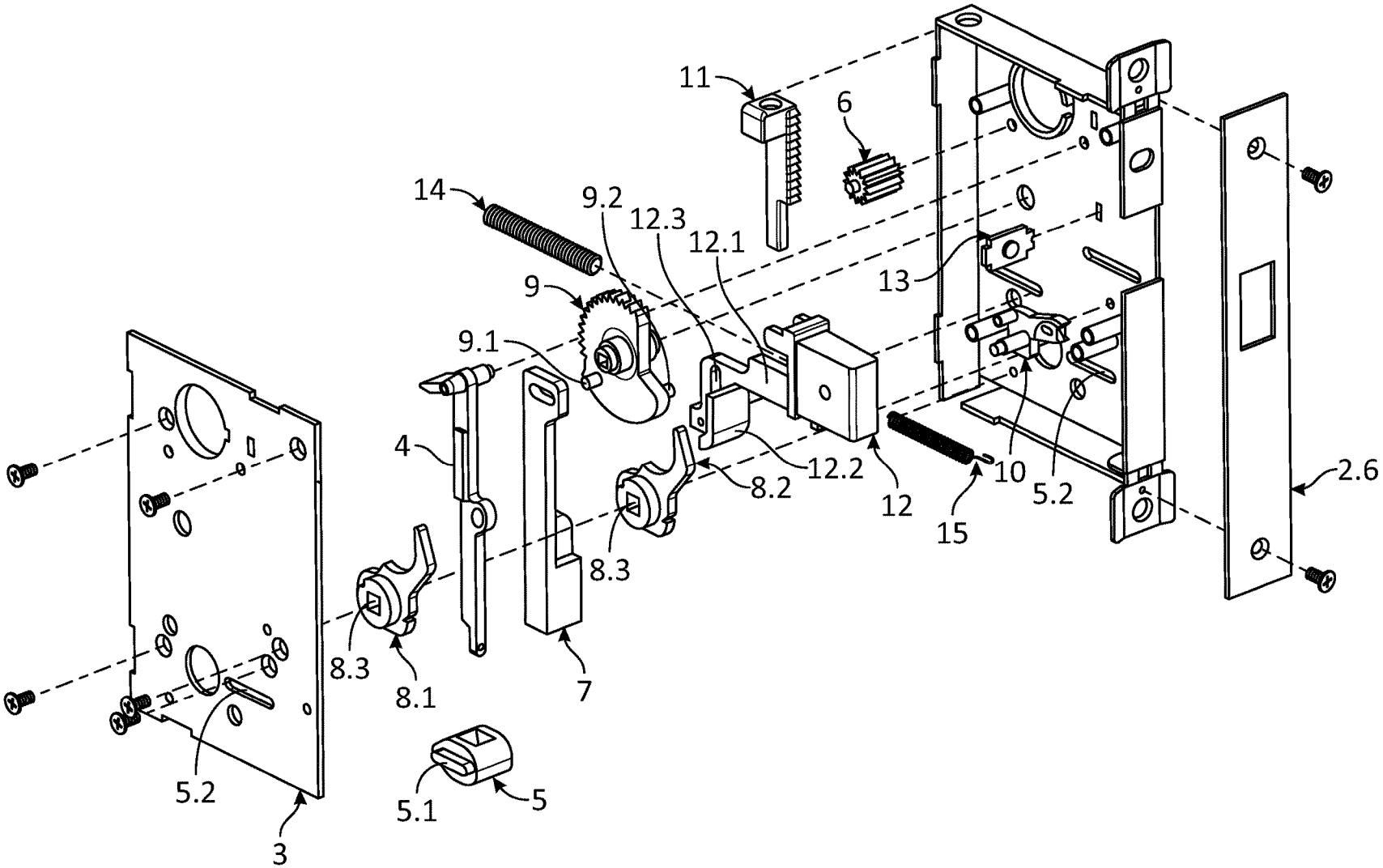
FIG. 3 is an exploded view of an embodiment of the lock body.

FIGS. 2 and 3 show the relative arrangement of the components of the lock body 1. FIG. 2 shows a side elevation view of the lock body 1 taken along section line A-A with the cover 3 removed. FIG. 3 shows an exploded view of the lock body 1. Referring to FIG. 2, the housing 2 includes a side wall 2.1, and top, bottom, front and rear walls 2.2, 2.3, 2.4 and 2.5, respectively. The front wall 2.4 has an opening for the front deadbolt 12. A face plate 2.6 is secured to the front wall of the housing 2 and has an opening which corresponds to the opening in the front wall 2.4. In the housing, actuators 12.1, 11, 7 and are mounted and coupled, respectively, to front, top and bottom deadbolts 12, 11.1, 7.1 for moving the front, top and bottom deadbolts 12, 11, 7 between their respective retracted and extended positions. The top and bottom deadbolts 11.1, 7.1 are connected to the top and bottom actuators 11, 7 via their respective extension rods 11.2, 7.2. The front, top and bottom deadbolts 12 11.1, 7.1 are shown in their respective extended positions. The front, top and bottom deadbolts 12, 11.1, 7.1 are coupled to each other via main gear 9 and small gear 6. The main gear 9 is rotatably mounted in the housing 2 and has a toothed outer circumference and drive pins 9.1 and 9.2 extending from either side wall of the gear 9. Bottom deadbolt actuator 7 and front deadbolt actuator 12.1 have oblong holes 7.2 and 12.3 which respectively receive the drive pins 9.1 and 9.2 of the main gear 9. The top actuator 11 has a serrated or toothed portion and is coupled to the main gear 9 via the toothed portion that mates with small gear 6.

The front deadbolt 12 is biased toward the extended position by compression spring 14. One end of the compression spring 14 is secured to spring anchor 13 and the other end to a rear face of the front deadbolt 12.

The lock body 1 further includes a bolt locking arm 10 for deadlocking the front deadbolt 12 in its extended position. The bolt locking arm 10 is pivotal about pin 10.2 between an upper locked position and a lower unlocked position. In the locked position shown in FIG. 2, locking finger 10.3 of bolt locking arm 10 is aligned with shoulder 12.4 of the front deadbolt actuator 12.1 and prevents movement of the front deadbolt 12 from its extended to its retracted position.

With continuing reference to FIGS. 2 and 3, the lock body 1 also includes inner spindle cam 8.1 and outer spindle cam 8.2 for moving the deadbolts from their respective extended positions to their retracted positions. The spindle cams 8.1, 8.2 are rotatably mounted in the housing 2 through openings 8.3 for receiving the spindle of respective external and internal door levers (not shown) so that the spindle cams 8.1, 8.2 can be independently rotated by turning the external or internal door lever.

The spindle cams 8.1, 8.2 are operatively coupled with the bolt locking arm 10 via locking slider 5 and bolt locking arm actuator 4 so that the bolt locking arm 10 is pivoted downward to its unlocked position when spindle cam 8.1 or 8.2 is rotated to return the front deadbolt 12 to its retracted position. The bolt locking arm actuator 4 has a top end 4.1 and a bottom end 4.4 and is supported in the housing 2 for pivoting about its top end 4.1. Between its top and bottom ends 4.1, 4.4, locking arm 4 is provided with an opening 4.2 which receives bolt locking arm pin 10.1. The locking slider 5 is mounted on the bottom end 4.4 of the bolt locking arm actuator 4 and is supported in horizontal slots 5.2 provided in the cover 3 and sidewall 2.1 via ridges 5.1 provided on opposing sides of the locking slider 5 for movement in the horizontal direction.

The return of the deadbolts from their respective extended positions to their retracted positions is described in more detail below.

Figure 4:
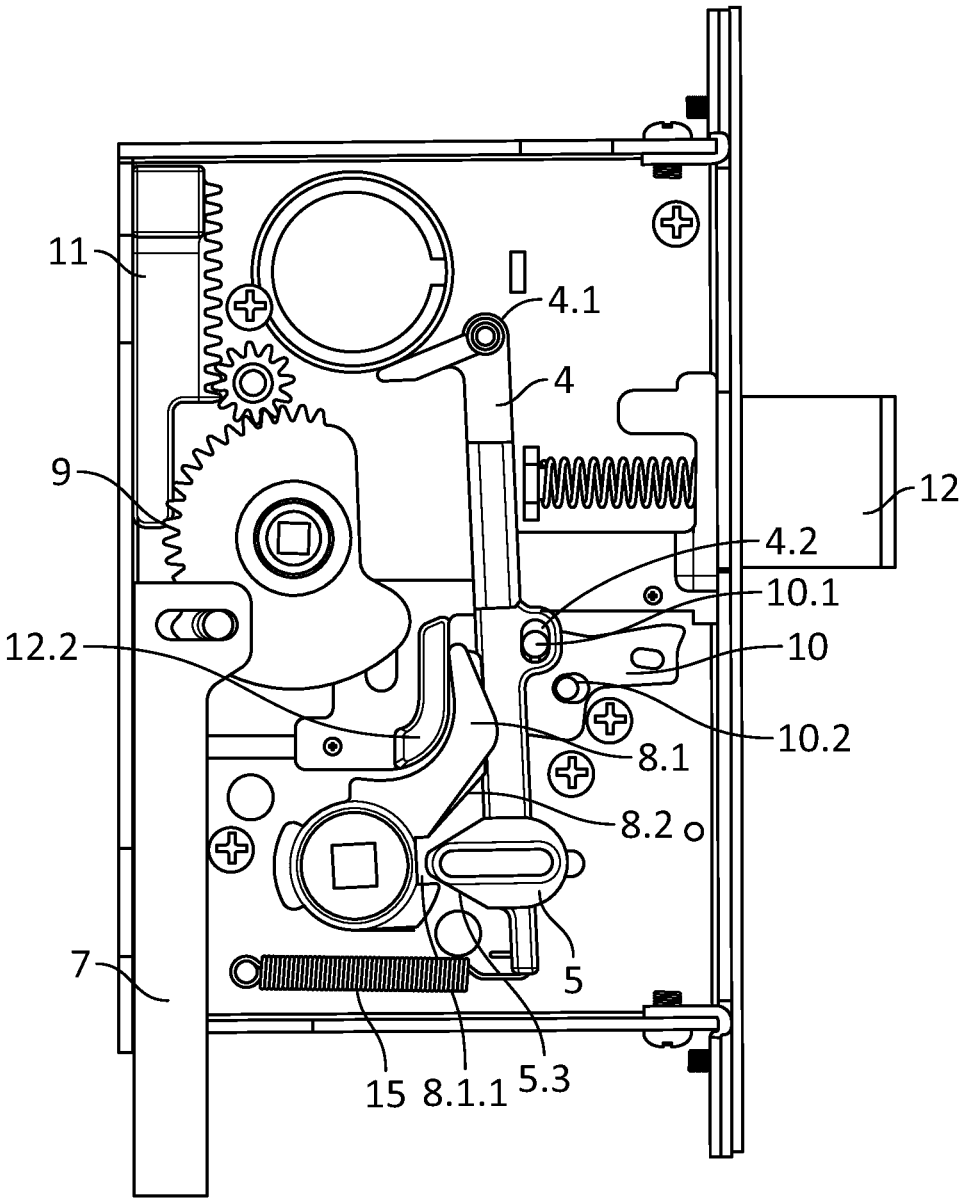
FIG. 4 is a side elevation view of the interior of the new locking deadbolt assembly with the inner spindle cam slightly rotated rearwardly with respect to the front face of the lock body housing.

FIG. 4 shows the position of the spindle cam 8.1 after a partial CCW rotation from its position shown in FIG. 2 which corresponds to rearward rotation with respect to the front wall of the housing. CCW rotation of spindle cam 8.1 causes it to engage the bottom slanted surface 5.3 of locking slider 5 resulting in movement of locking slider 5 toward the right out of opening 8.1.1 of spindle cam 8.1. As a result, bolt locking arm actuator 4 is pivoted CCW about its top end 4.1, which in turn causes downward pivoting of bolt locking arm 10 about pin 10.2 via engagement of opening 4.2 of bolt locking arm actuator 4 with bolt locking arm pin 10.1.

Figure 5:
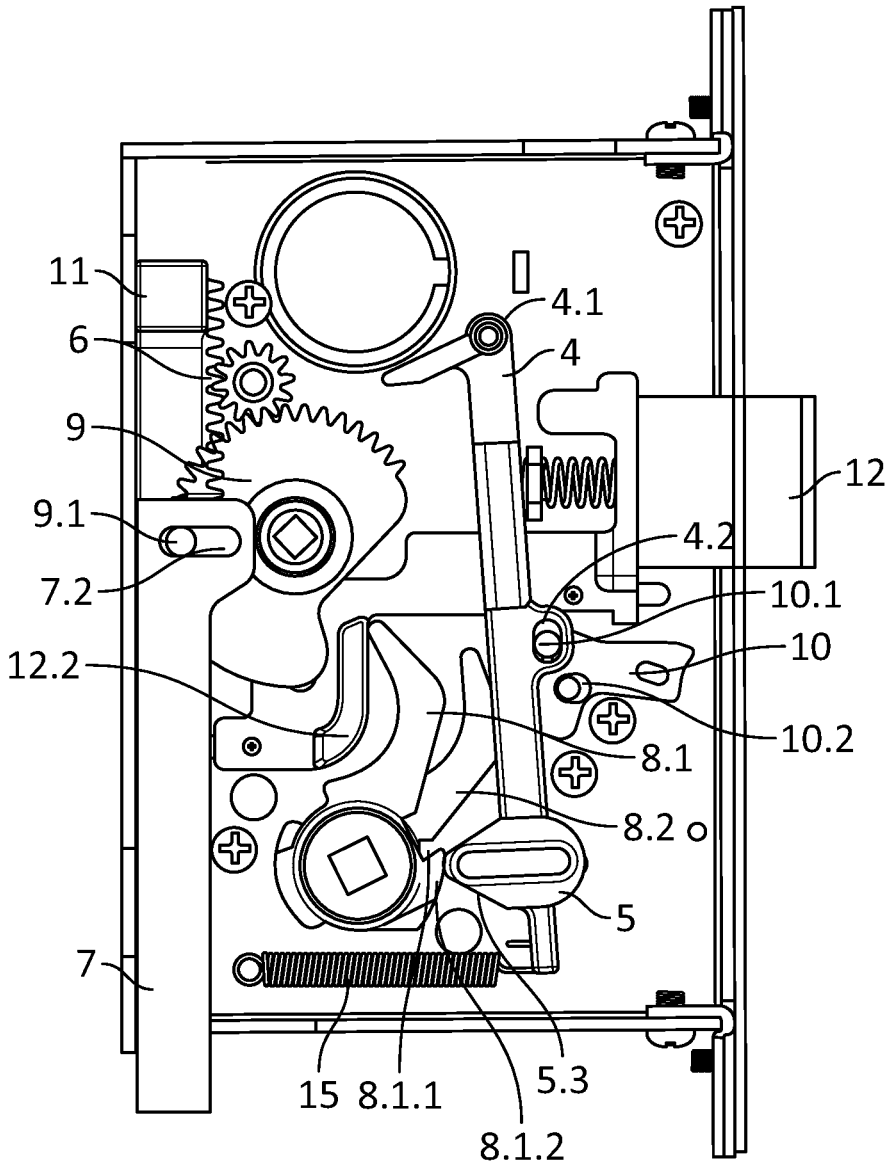
FIG. 5 is a side elevation view of the interior of the new locking deadbolt assembly with the inner spindle cam rotated further rearwardly from the position shown in FIG. 4.

FIG. 5 shows the position of the components of the lock body 1 after further CCW rotation of internal spindle cam 8.1 from its position shown in FIG. 4. Internal spindle cam 8.1 has engaged vertical portion 12.2 of front deadbolt actuator 12.1 and has moved front deadbolt 12 rearward toward its retracted position. This has caused main gear 9 to rotate CW via engagement of drive pin 9.2 with oblong hole 12.3 of front deadbolt actuator 12.1. CW rotation of main gear 9 also causes movement of top and bottom actuators 11, 7 towards their retracted positions via interaction of drive pin 9.1 with oblong hole 7.2 of bottom actuator 7 and CCW rotation of small gear 6. bolt locking arm actuator 4 has been further pivoted CCW through interaction of locking slider 5 with surface 8.1.2 of spindle cam 8.1. Spring 15 which is mounted in the housing and attached to the bottom end of bolt locking arm actuator 4 is tensioned and biases bolt locking arm actuator 4 toward the left. As a result of engagement of locking slider 5 on surface 8.1.2 of spindle cam 8.1, bolt locking arm 10 is held in the unlocked position against the bias of tensioned spring 15.

Figure 6:
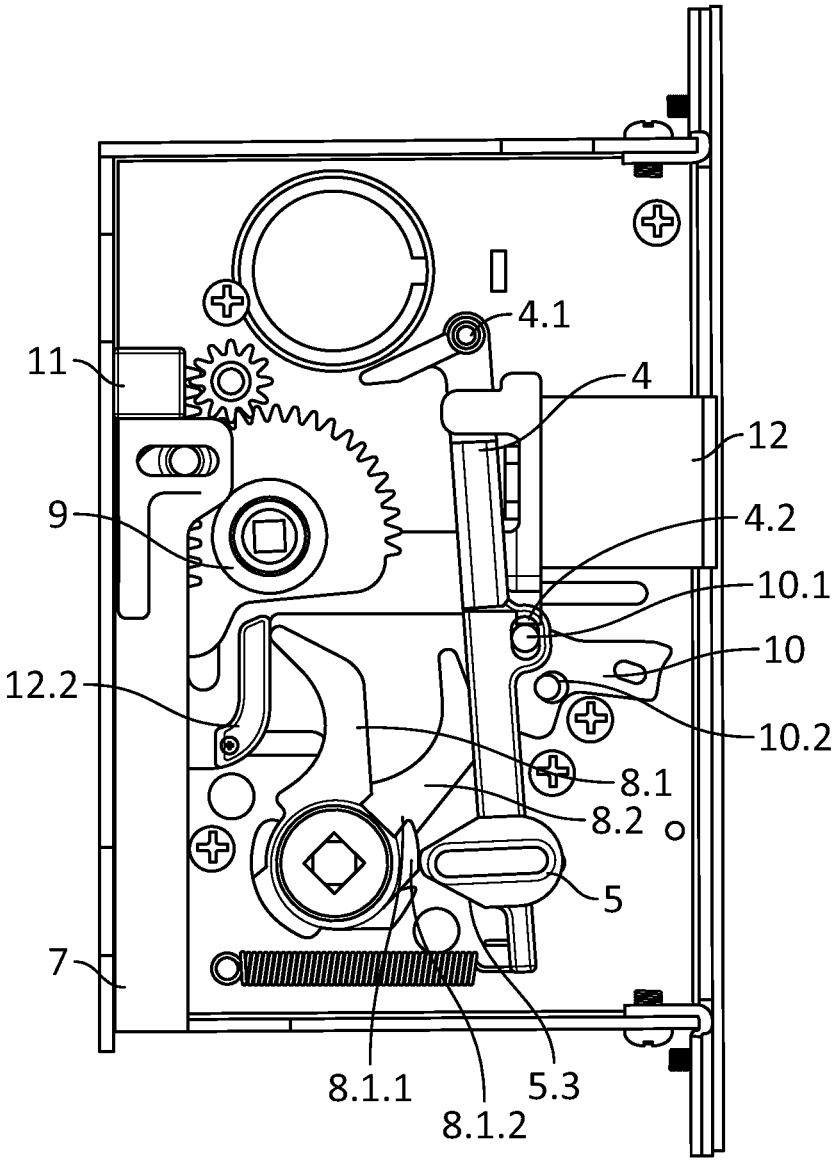
FIG. 6 is a side elevation view of the interior of the new locking deadbolt assembly with the inner spindle cam rotated further rearwardly from the position shown in FIG. 5 and with the deadbolts in the retracted position.

FIG. 6 shows the components of the lock body 1 after further CCW rotation of inner spindle cam 8.1 from its position shown in FIG. 5 with the deadbolt actuators in their fully retracted positions. Further rearward movement of the front deadbolt actuator 12.1 has caused further CW rotation of the main gear 9, and as a result, further retraction of the top and bottom actuators 11, 7. In this position, spring 14 is compressed between spring anchor 13 and front deadbolt 12.

Figure 7A:
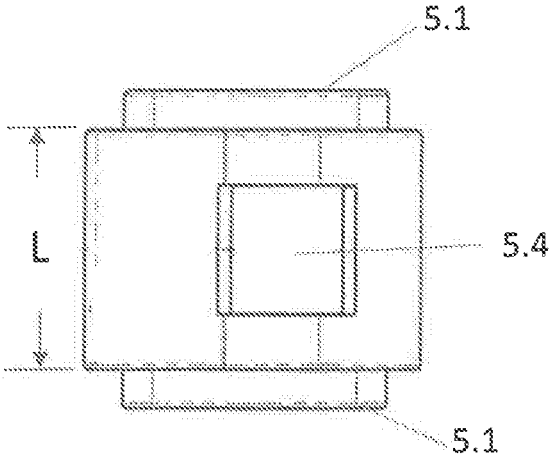
FIG. 7A is a top view of a first embodiment of a locking slider according to the invention.
Figure 7B:
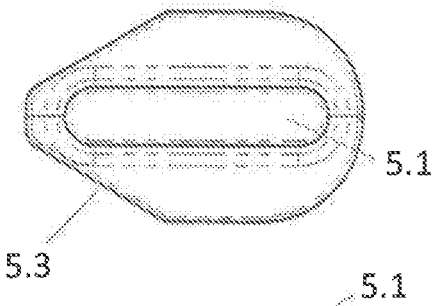
FIG. 7B is a side view of the first embodiment of the locking slider.
Figure 7C:
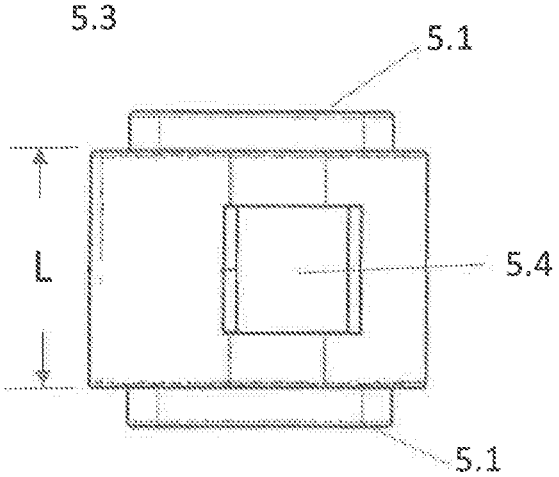
FIG. 7C is a bottom view of the first embodiment of the locking slider.

In certain embodiments, the locking deadbolt assembly can be constructed so that the deadbolts can either be returned to their retracted positions by actuating either of the internal or external door levers or only to permit return of the deadbolts by actuating the internal door lever. This can be accomplished by correspondingly designing the locking slider 5. FIGS. 7A-C show an embodiment of the locking slider 5 which is constructed so that the bolt locking arm 10 can be disengaged from its deadbolting position and the deadbolts returned to their retracted position by actuating either of the external or internal door levers. FIGS. 7 A-C show, respectively, top, side and bottom views of the locking slider 5. In this embodiment, the locking slider 5 has a smooth slanted configuration along the entire length L of its end facing the spindle cam openings 8.1.1, 8.2.1. FIGS. 7A-C further show the ridges 5.1 with which the locking slider 5 is supported in the horizontal slots 5.2 of the housing, and opening 5.4 with which the locking slider 5 is mounted on the bottom end 4.4 of bolt locking arm actuator 4. In the embodiment shown in FIGS. 7A-C, both spindle cams 8.1 and 8.2 interact with the locking slider 5 in the manner described for the inner spindle cam 8.1 above. Thus, rotation of either spindle cam 8.1 or 8.2 causes the locking slider 5 to move in a horizontal direction toward the front side of the housing 2 which results in CCW pivoting of the bolt locking arm actuator 4 and downward pivoting of bolt locking arm 10 to its unlocked position.

Figure 8A:
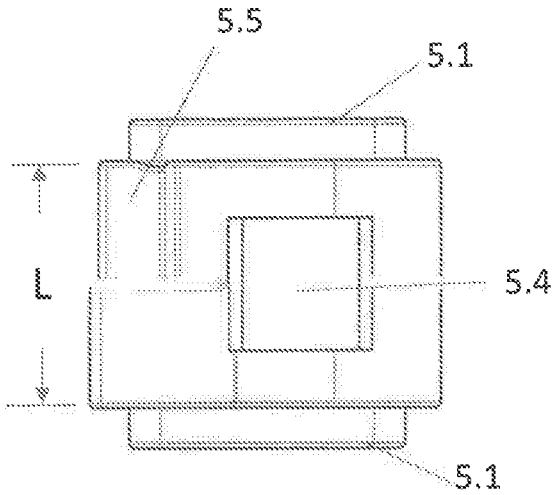
FIG. 8A is a top view of a second embodiment of a locking slider according to the invention.
Figure 8B:
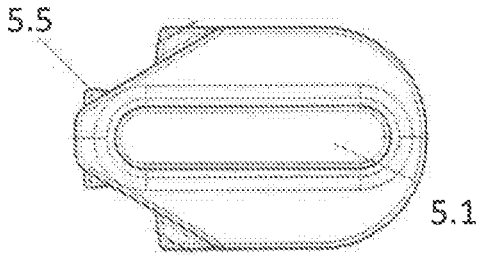
FIG. 8B is a side view of the second embodiment of the locking slider.
Figure 8C:
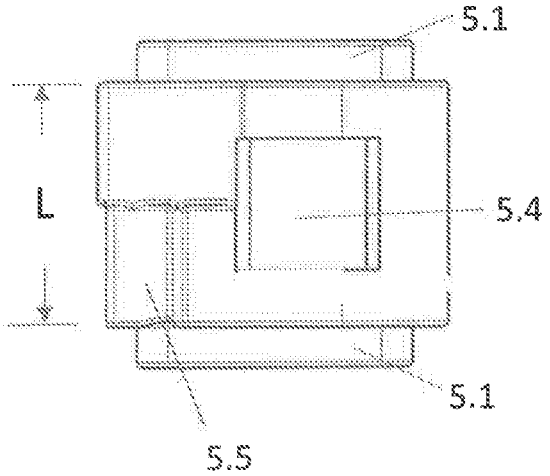
FIG. 8C is a bottom view of the second embodiment of the locking slider.

FIGS. 8A-C show an embodiment of the locking slider 5 which is configured so that the bolt locking arm 10 can only be disengaged from its deadbolting position and the deadbolts returned to their retracted position by turning the internal door lever, but not by turning the external door lever. FIGS. 8 A-C are, respectively, top, side and bottom views of the locking slider 5. In this embodiment, the locking slider 5 has a smooth slanted configuration in the region of its end that engages with the spindle cam opening 8.1.1 of the inner spindle cam 8.1 and a square configuration 5.5 in the region of its end that engages with the spindle cam opening 8.2.1 of the outer spindle cam 8.2. Engagement of the square configuration in the spindle cam opening 8.2.1 blocks CCW rotation of the spindle cam 8.2 and prevents the locking slider 5 from being pushed out of the spindle cam opening 8.2.1. As a result, the bolt locking arm actuator 4 cannot be pivoted CCW to disengage bolt locking arm 10 from its deadbolting position by turning the outer spindle cam 8.2 with an external door lever. However, this embodiment still permits disengagement of the bolt locking arm 10 from its deadbolting position by manually rotating the inner spindle cam 8.1 using the internal door lever.

Figure 9:
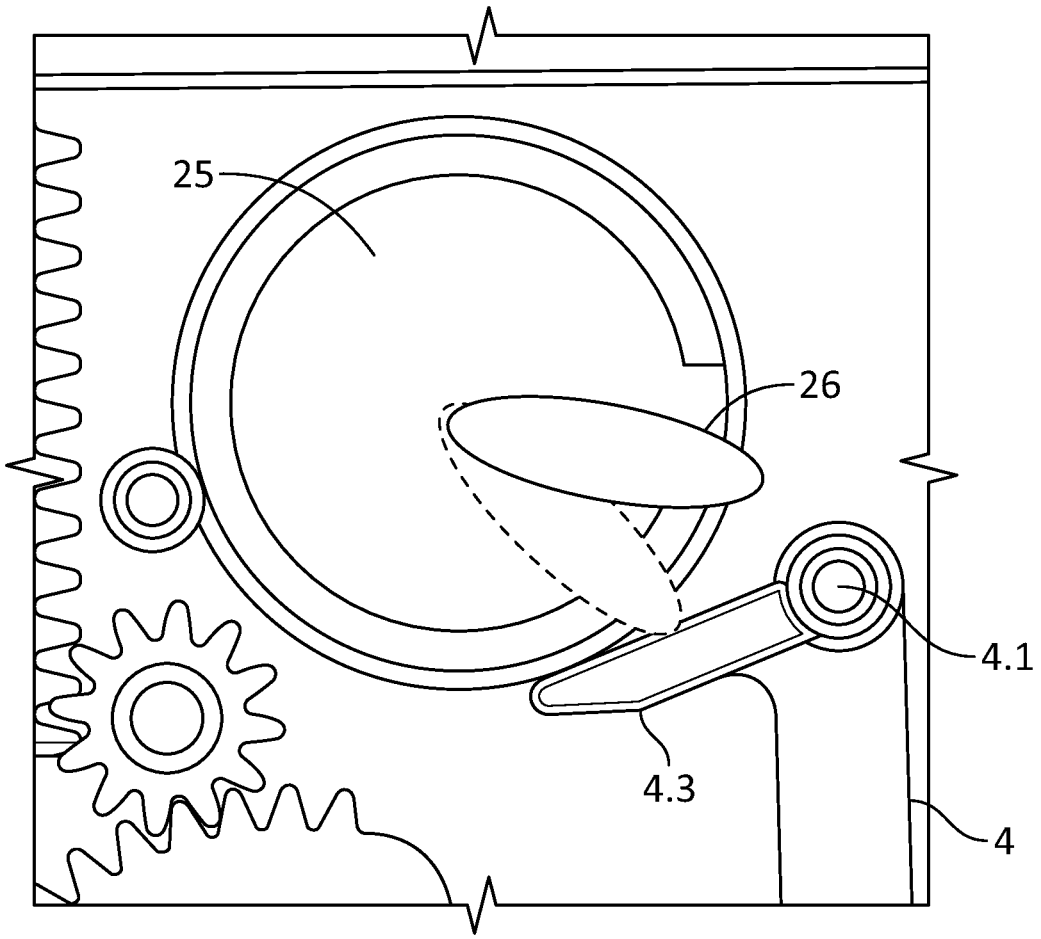
FIG. 9 is an enlarged side elevation view of a portion of the new locking deadbolt assembly of FIG. 6 showing the interaction between the key cylinder cam and the tongue of the bolt locking arm actuator.
Figure 10A:
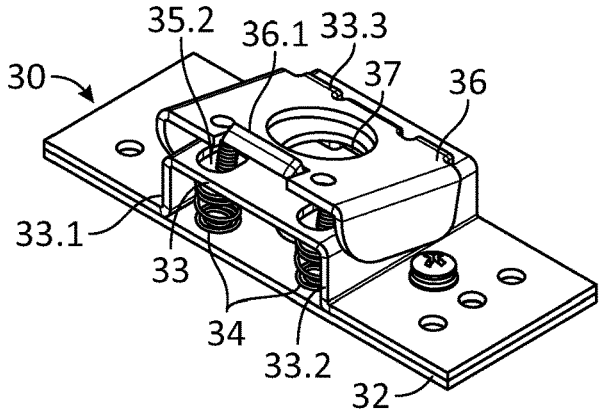
FIG. 10A is a top, front and left side perspective view of the trigger mechanism in the holding position.
Figure 10B:
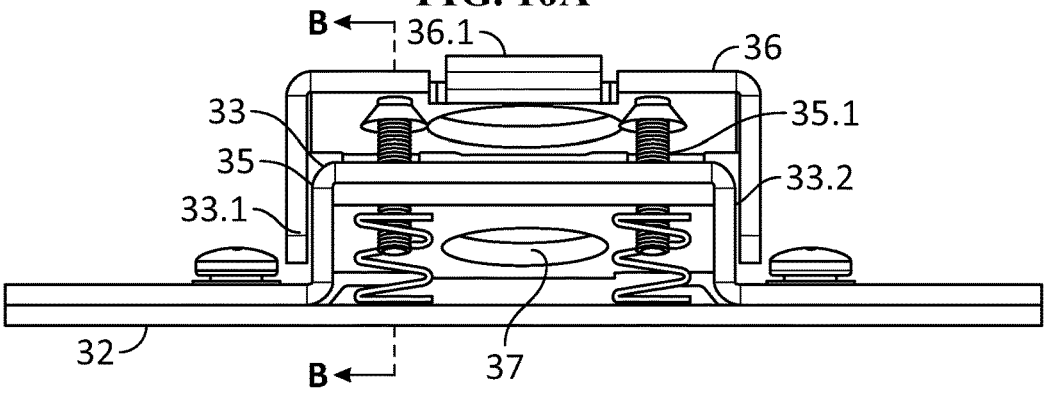
FIG. 10B is a front elevation view of the trigger mechanism of FIG. 10A.
Figure 10C:
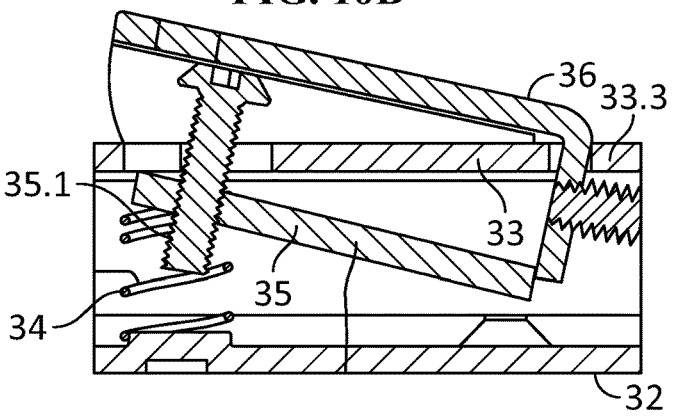
FIG. 10C is a cross-sectional view of the trigger mechanism of FIG. 10B taken along the direction of the arrows B-B.
Figure 10D:
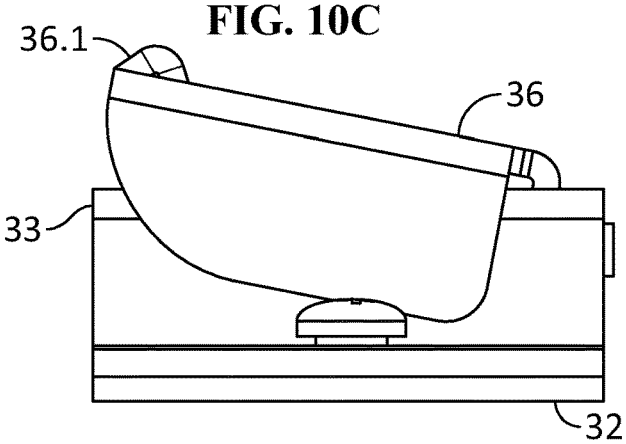
FIG. 10D is a side elevation view of the trigger mechanism of FIG. 10A.
Figure 11A:
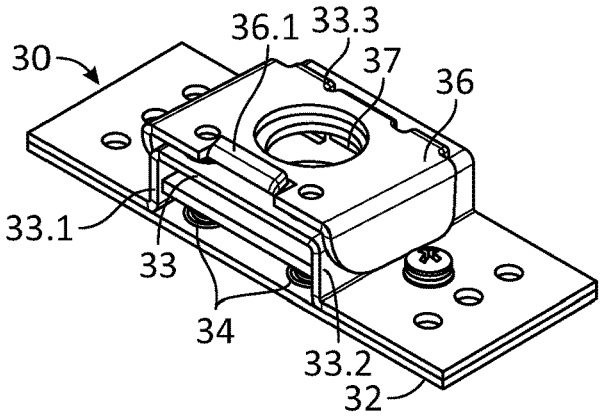
FIG. 11A is a top, front and left side perspective view of the trigger mechanism in the release position.
Figure 11B:
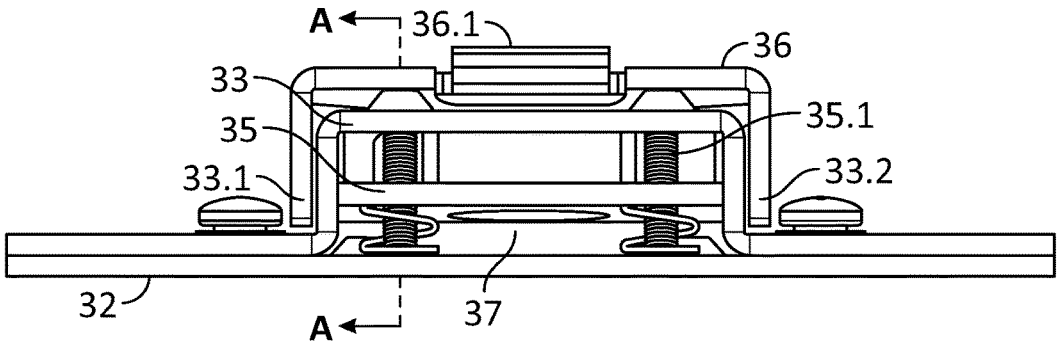
FIG. 11B is a front elevation view of the trigger mechanism of FIG. 11A.
Figure 11C:
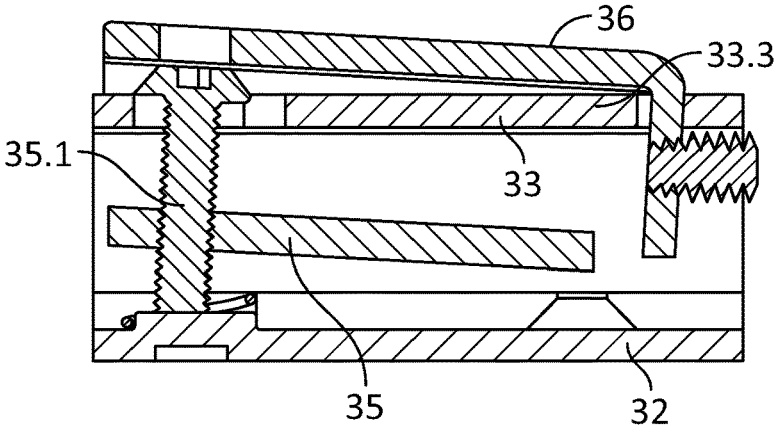
FIG. 11C is a cross-sectional view of the trigger mechanism of FIG. 11B taken along section line A-A.
Figure 11D:
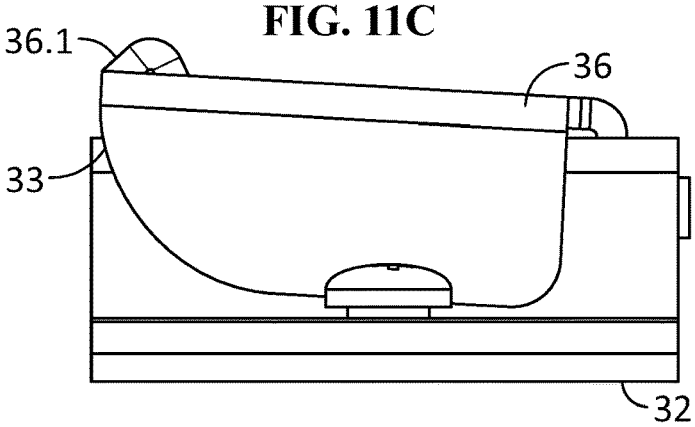
FIG. 11D is a side elevation view of the trigger mechanism of FIG. 11A.

The bolt locking arm 10 can also be disengaged from its deadbolting position by turning a key cylinder 25 received in the housing and having a cam 26 as shown in FIG. 9. CW turning of the key cylinder 25 causes the cam 26 to engage with the tongue 4.3 of bolt locking arm actuator 4 and to push the tongue 4.3 downward, thereby causing CCW rotation of bolt locking arm actuator 4 about top end 4.1, and downward pivoting of bolt locking arm 10. This allows disengagement of the bolt locking arm 10 from its deadbolting position from the outside with an authorized key and retraction of the deadbolts by turning the external lever. In other words, in the embodiment of the lock with the locking slider shown in FIGS. A-C, the door can still be opened from the outside by using authorized key and then turning the external lever.

In the retracted position of the deadbolts, spring 14 is tensioned and the deadbolts are biased towards their extended positions. The deadbolts are coupled via the main gear 9 and small gear 6 such that holding one of the deadbolts in its retracted position will block and prevent movement of the other deadbolts from their retracted to their extended positions. For example, holding the top deadbolt 11.1 in its retracted position prevents the bottom deadbolt 7.1 and front deadbolt 12 from moving to their respective extended positions. Upon release of the top deadbolt 11.1, the front deadbolt 12 is urged by spring 14 towards its extended position. This results in CCW rotation of the main gear 9, which causes the top and bottom deadbolts 11.1, 7.1 to move to their respective extended positions. Movement of the front deadbolt 12 to its extended position also causes CW rotation of the inner and outer spindle cams 8.1, 8.2 to positions in which the spindle cam openings 8.1.1, 8.2.1 are oriented horizontally. This permits locking slider 5 to move to the left driven by tensioned spring 15 to engage in spindle cam openings 8.1.1, 8.2.1 which causes CW rotation of bolt locking arm actuator 4, which in turn results in the upward pivoting of bolt locking arm 10 to its deadbolting position.

Referring now to FIGS. 10A-D and FIGS. 11A-D, there is shown an embodiment of a trigger mechanism 30 according to the present invention for releasably holding one of the deadbolts in its retracted position. FIGS. 10A-D show the trigger mechanism in its holding position in which the locking plate is inclined with respect to the base plate 32 and the upper plate 33. FIGS. 11A-D show the trigger mechanism 30 in its release position in which the locking plate 35 is pivoted downwardly to form a smaller angle with the base plate 32 and the upper plate 33.

The trigger mechanism 30 has a base plate 32, an upper plate 33 secured to the base plate 32 in spaced-apart and parallel relationship via legs 33.1, 3.2, a locking plate 35 arranged between the base plate 32 and the upper plate 33 and a trigger plate 36. The locking plate 35 has adjustable screws 35.1 received in threads provided at front corners of the locking plate 35. The screws extend upwardly through openings 35.2 in the upper plate 33. The locking plate 35 is mounted to pivot between upper position and lower positions and is biased toward the upper position by springs 34 positioned between the base plate 32 and the locking plate 35.

The trigger plate 36 is pivotally mounted in slots 33.3 in the upper plate 33 for pivoting between an upper and a lower position and has a raised portion 36.1 at its front edge for facilitating engagement of the trigger plate 36 with the door jamb. Downward pivoting of the trigger plate 36 causes its front edge to bear down on the screws received in the locking plate 35 and causes downward pivoting of the locking plate 35 toward its lower position in opposition to the bias of the springs 34. The screws can be rotated to move them in or out to adjust the distance the trigger plate 36 has to pivot downwards to cause downward pivoting of the locking plate 35. This allows adjustment of the trigger mechanism to accommodate the distance between the top of the door and the door jamb when mounting the trigger mechanism in a recess having a predetermined depth in the top of the door.

The base plate 32, upper plate 33, locking plate 35 and trigger plate 36 are provided with apertures 37 for receiving the top deadbolt therein. The diameter D of the aperture of the locking plate 35 is dimensioned so that in the lowered position of the locking plate 35 the top deadbolt 11.1 can extend unrestrained through the apertures of the base plate 32, the locking plate 35, the upper plate 33 and the trigger plate, and in the lowered position of the locking plate 35, the edges of the locking plate 35 engage the surface of the top deadbolt 11.1 so as to prevent upward movement of the top deadbolt 11.1. The aperture of the trigger plate 36 is dimensioned to permit free passage of the top deadbolt in the upper and lower position of the trigger plate 36.

Figure 12A:
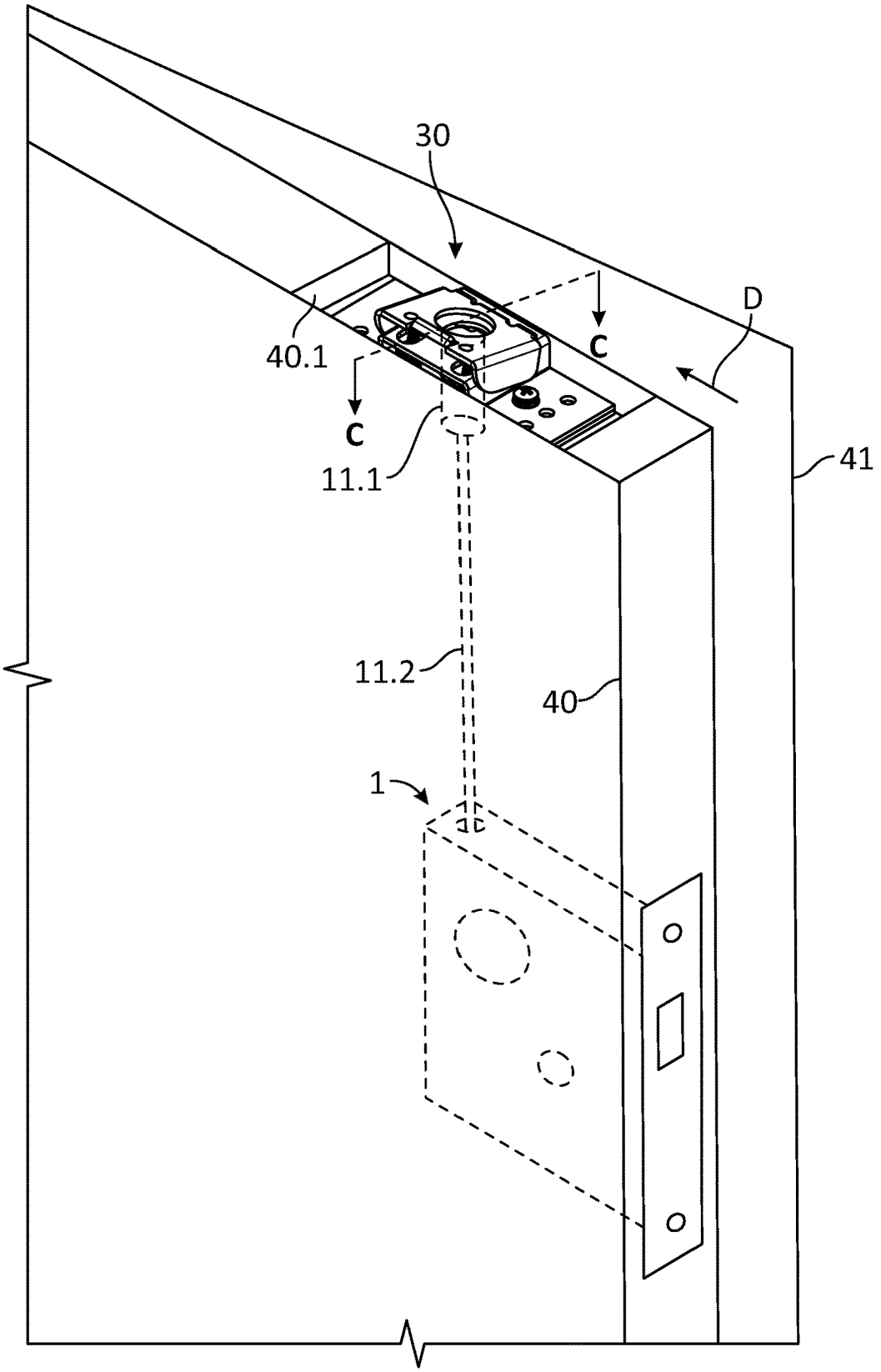
FIG. 12A is a perspective view of the trigger mechanism partly in phantom installed on the top of a door.

The trigger mechanism 30 is mounted on the door so that its apertures 37 are aligned with the deadbolt that is to be releasably held in its retracted position. FIG. 12A illustrates the arrangement of the trigger mechanism 30 in a recess 40.1 on the top of a door 40 so that its apertures are aligned with the top deadbolt 11.1. The trigger mechanism 30 is mounted recessed relative to the top door edge so as to allow unobstructed closing of the door 40, while at the same time enabling engagement of the trigger plate 36 with the door jamb 41 when the door is closed. FIG. 12A also shows the lock body 1 mounted in the interior of the door with the faceplate 3 secured to the front edge of the door. The extension rod 11.2 extends within the door and couples the top bolt 11.1 to the top actuator in the lock body 1.

Figure 12B:
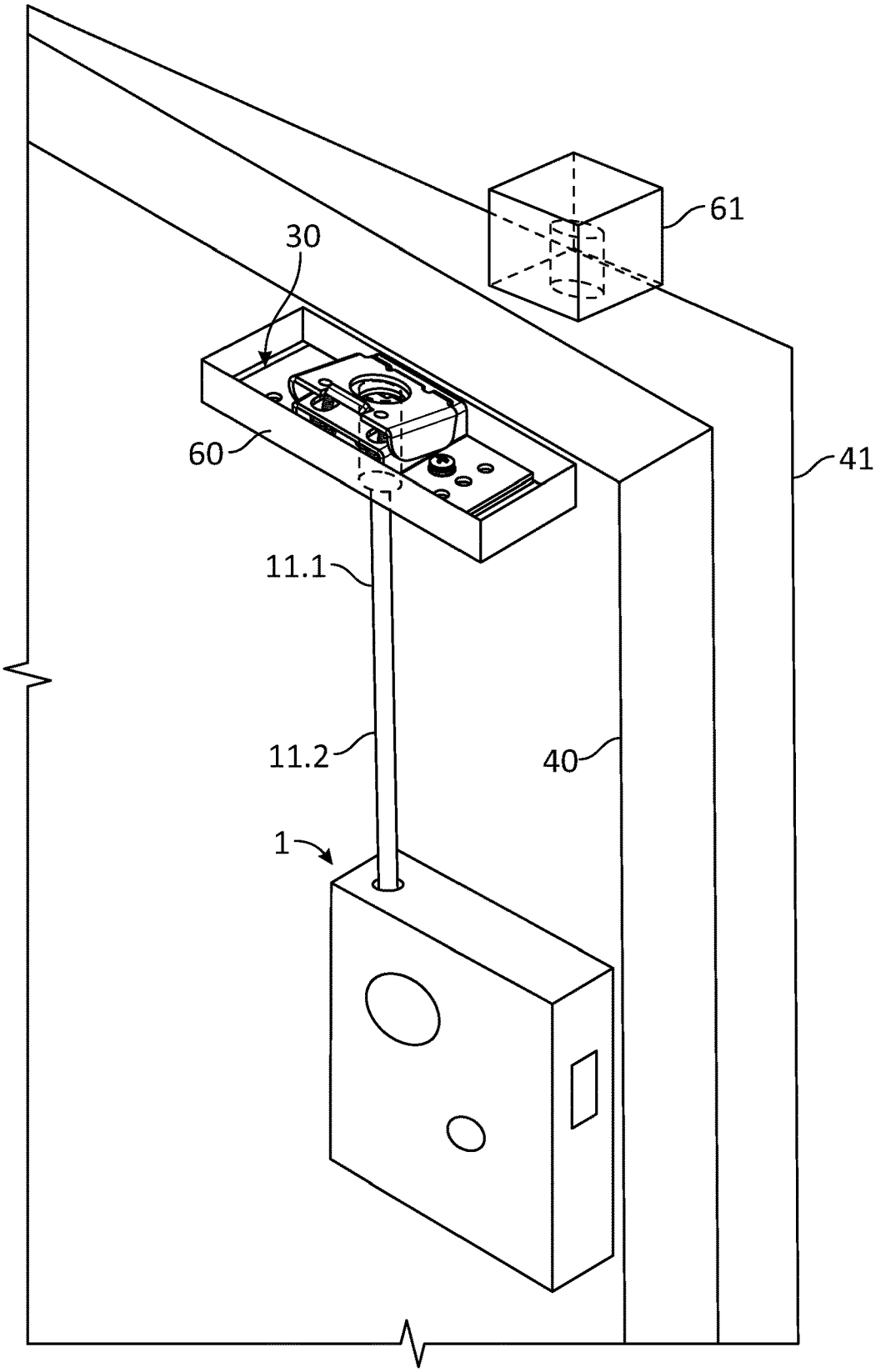
FIG. 12B is a perspective view of the trigger mechanism partly in phantom installed on the face of the door with a strike plate mounted on the jamb of the door.

In another embodiment, the lock body 1 is adapted for mounting on the face of the door 40 as schematically illustrated in FIG. 12B. In this embodiment the trigger mechanism 30 is mounted in a housing 60 on the face of the door and the strike plate 61 is mounted on a side of the door jamb 41 opposite the trigger mechanism 30.

Figure 13B:
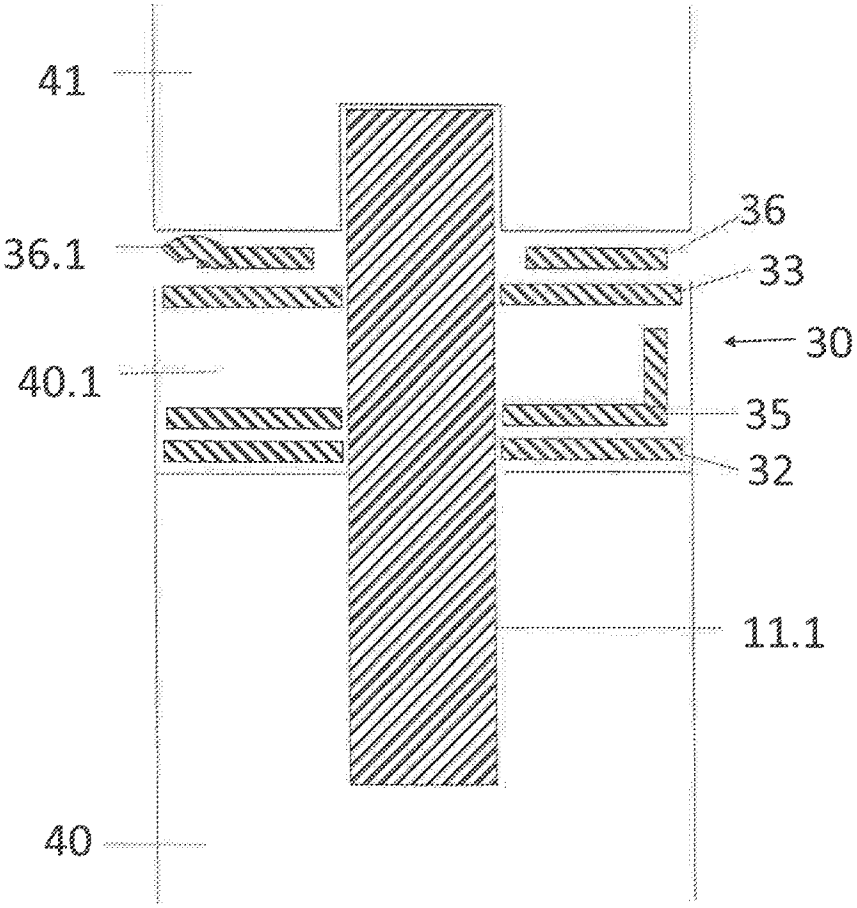
FIG. 13B shows a cross-section of the trigger mechanism of FIG. 12 along section line C-C in a view in the direction of the arrow D, with the trigger mechanism in the release position after closing the door, with the deadbolt received in a strike plate in the door jamb.
Figure 13A:
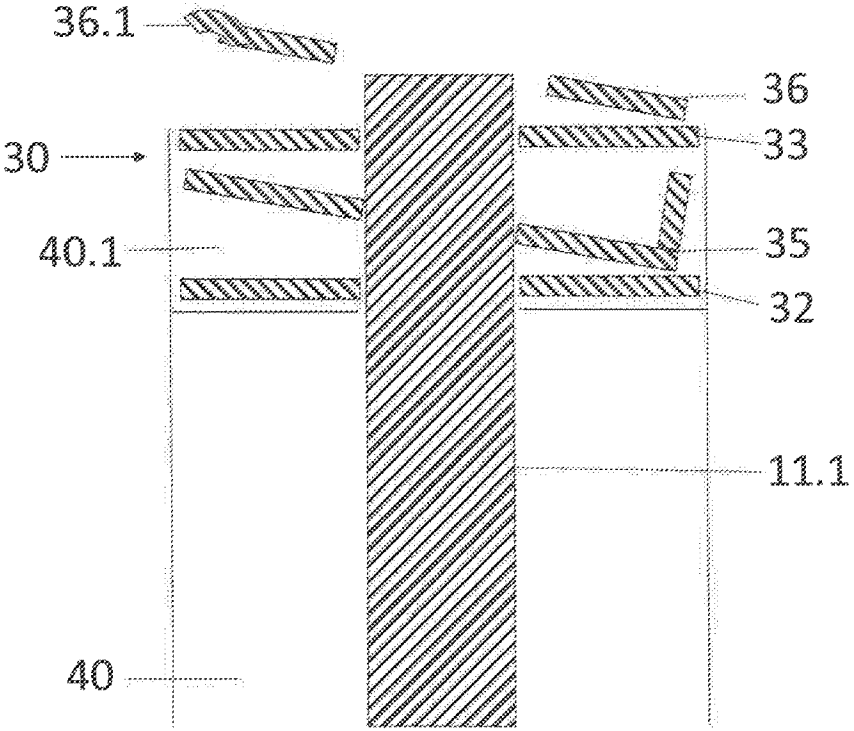
FIG. 13A shows a cross-section of the trigger mechanism of FIG. 12 along section line C-C in a view in the direction of the arrow D, with the trigger mechanism in the holding position.

FIGS. 13A and 13B schematically illustrate the interaction of the trigger mechanism 30 with the top bolt 11.1 in the holding position and the release position. FIGS. 13A and 13B show the trigger mechanism of FIG. 12 in a cross-section along section line C-C in a view taken in the direction of the arrow D. FIG. 13A shows the trigger mechanism 30 when the door is open, and FIG. 13B shows the trigger mechanism 30 when the door is closed and the trigger plate 36 has been pivoted downward as a result of its contact with the door jamb 41 and the top deadbolt 11.1 has extended into a strike plate in the door jamb 41. When the door is open, as illustrated in FIG. 13A, the trigger mechanism 30 is in the holding position with the locking plate in the lower position. In this position the edges of the aperture of the locking plate engage on the surface of the top deadbolt 11.1 so as to hold the deadbolt in the retracted position. When the door is closed as illustrated in FIG. 13B, the locking plate is pivoted to its lower position and deadbolt 11.1 is permitted to move to its extended position.

Figure 14B:
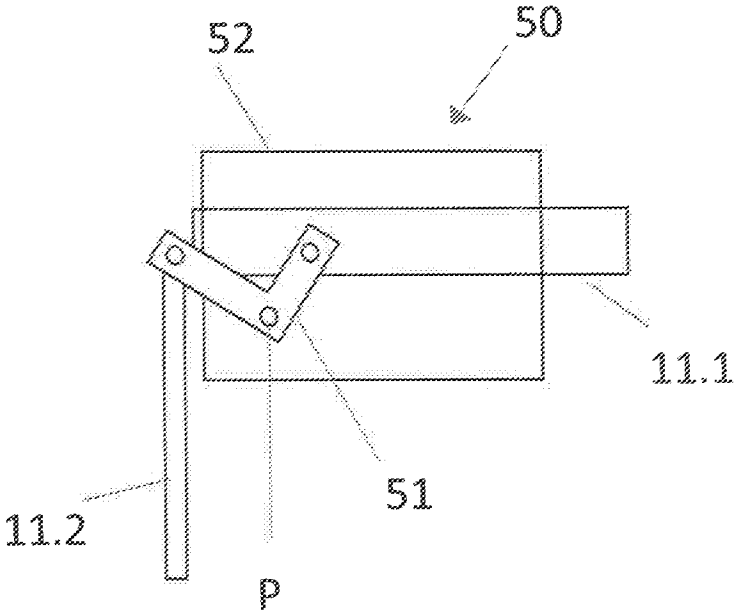
FIG. 14B shows the embodiment of FIG. 14A with the top deadbolt in the extended position.
Figure 14A:
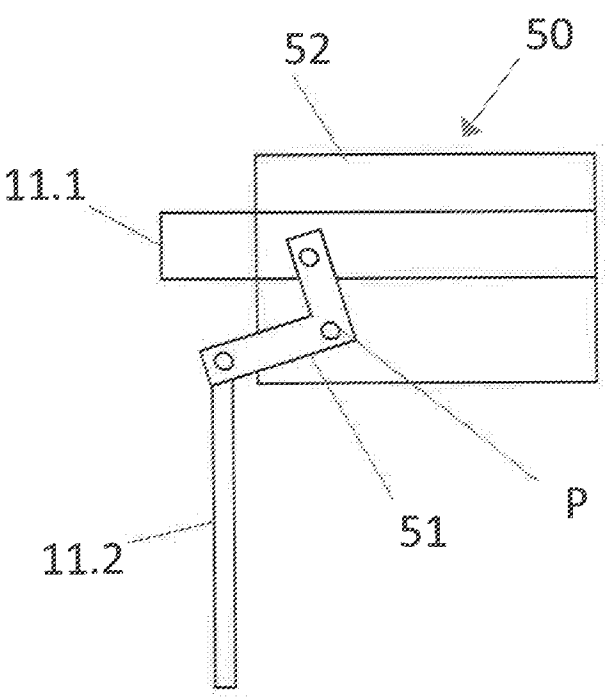
FIG. 14A is a schematic diagram of an embodiment of the lock assembly according to the present invention showing a pivot mechanism for movement of a top deadbolt in a horizontal direction, with the top deadbolt in the retracted position.

In another embodiment, the top and/or bottom deadbolts are mounted for movement in the horizontal direction when actuated by the top or bottom actuators and to engage in strike plates mounted in the adjacent side jamb of the door. In this embodiment, the top and/or bottom deadbolts are connected to the top or bottom actuators via a pivot mechanism 50 as schematically illustrated in FIGS. 14A-B for top deadbolt 11.1. The top deadbolt 11.1 is supported in a casing 52 mounted on the door and is connected to the top actuator (not shown) via L-shaped member 51 and extension rod 11.2. Movement of the top actuator 11 from its retracted to its extended position causes upward movement of extension rod 11.2 and pivoting of the L-shaped member about pivot point P. This results in the pivoting of the upper leg of the L shaped member to the right and movement of the top deadbolt 11.1 from its retracted position to its extended position into a strike plate mounted in the side door jamb.

Figure 15B:
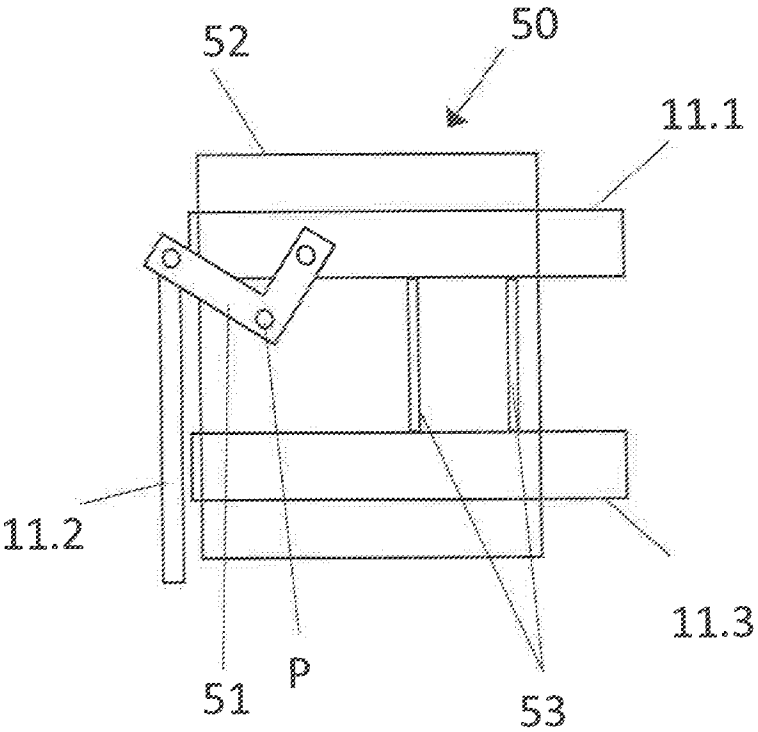
FIG. 15B shows the embodiment of FIG. 14B including an additional deadbolt.
Figure 15A:
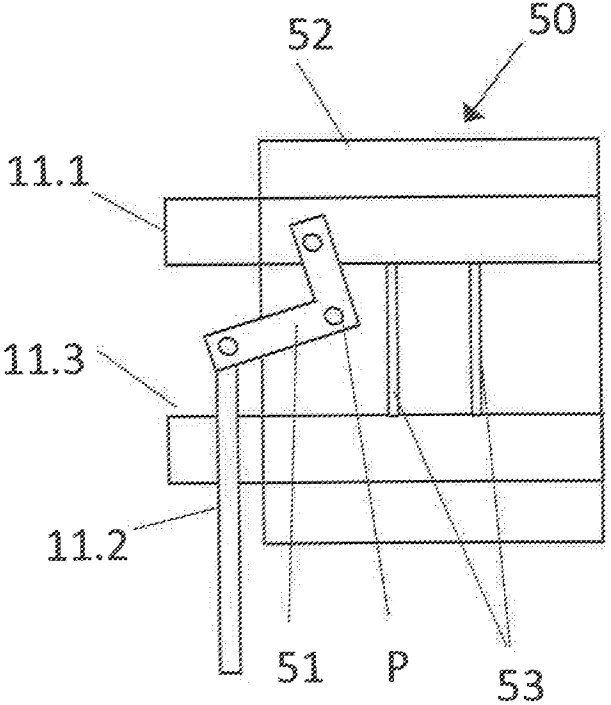
FIG. 15A shows the embodiment of FIG. 14A, including an additional deadbolt.

The embodiment shown in FIGS. 14A-B can be modified to include a further deadbolt connected to the top deadbolt 11.1 so as to move simultaneously with the top deadbolt 11.1. Such an embodiment is shown in FIGS. 15A-B. The further deadbolt 11.3 is connected to the top deadbolt 11.1 by bracket members 53. When the top and bottom deadbolts are modified as shown in FIG. 14A-B or 15A-B, the automatic locking-deadbolt assembly can include 4 or 5 deadbolts.

The invention has been explained with reference to an exemplary embodiments including 3, 4 or 5 deadbolts. However, embodiments including 2 deadbolts or only a single deadbolt are also within the scope of the invention. Moreover, embodiments of the invention with only 2 or a single deadbolt will provide the deadbolting function and door lever actuated deadbolt retraction described in connection with the embodiment including three deadbolts. For example, the lock assembly 1 can include the top deadbolt actuator 11 and top deadbolt 11.1, but not the bottom deadbolt actuator 7, the bottom deadbolt 7.1 and the front deadbolt 12. Such an embodiment will still include the front deadbolt actuator 12.1.

In an embodiment in which the front deadbolt 12 is the only deadbolt, the trigger mechanism can be mounted on the front edge of the door so that the apertures are aligned with the front deadbolt. In this embodiment, the front deadbolt 12 preferably has round cross-section corresponding to the apertures of the trigger mechanism. The lock body 1 in such an embodiment is mounted recessed with respect to the front edge of the door to permit corresponding recessed mounting of the trigger mechanism as explained above in connection with the mounting of the trigger mechanism on the top edge of the door.

What is claimed as new and desired to be protected is set forth in the appended claims and includes equivalents of the elements recited therein.

The invention claimed is:

1. A lock assembly for a door, comprising:

a lock body having a housing;

a first deadbolt operatively coupled with a first actuator supported in the housing, said first deadbolt supported for linear movement between a retracted position and an extended position and biased toward the extended position by a spring force of a spring mounted in the housing; and a trigger mechanism mounted on the door for engagement with a door jamb upon closing of the door, said trigger mechanism in direct contact with the first deadbolt and adapted to hold the first deadbolt in the retracted position when the door is open in opposition to said spring force, and to permit movement of the first deadbolt to the extended position upon contact of the trigger mechanism with the door jamb;

wherein the trigger mechanism includes:

a base plate and an upper plate connected in a spaced apart and parallel relation, a locking plate received between the base plate and the upper plate and pivotable between an upper position and a lower position, and a trigger plate positioned over the locking plate and configured to cause pivoting of the locking plate from the upper position to the lower position in response to engagement of the trigger plate with the door jamb, said base plate, upper plate, locking plate and trigger plate respectively provided with apertures which are aligned for slidingly receiving the first deadbolt therethrough;

wherein in the upper position of the locking plate, the first deadbolt is held in the retracted position by engagement with an edge of the aperture of the locking plate; and in the lower position of the locking plate, movement of the first deadbolt through the apertures from the retracted to the extended position is permitted.

2. The lock assembly of claim 1, further comprising a bolt locking arm operatively coupled to the first deadbolt and supported in the housing for movement between an unlocked position permitting movement of the first deadbolt from the extended position to the retracted position and a locked position preventing movement of the first deadbolt from the extended position to the retracted position, wherein movement of the first deadbolt from the retracted position to the extended position causes pivoting of the bolt locking arm from the unlocked position to the locked position.

3. The lock assembly of claim 2, further comprising an inner spindle cam rotatably supported in the housing and coupled to the first deadbolt and the bolt locking arm so that rearward rotation of the inner spindle cam with respect to a front side of the housing causes pivoting of the bolt locking arm from the locked position to the unlocked position and movement of the first deadbolt from the extended position to the retracted position.

4. The lock assembly of claim 3, further comprising an outer spindle cam rotatably supported in the housing independently of the inner spindle cam and coupled to the first deadbolt and the bolt locking arm so that rearward rotation of the outer spindle cam with respect to the front side of the housing causes pivoting of the bolt locking arm from the locked to the unlocked position and movement of the first deadbolt from the extended position to the retracted position.

5. The lock assembly of claim 3, further comprising a bolt locking arm actuator pivotally supported in the housing and coupled to the bolt locking arm, the bolt locking arm actuator adapted to pivot in response to engagement by a cam of a key cylinder securely positioned in an opening in a side wall of the housing thereby cause pivoting of the bolt locking arm from the locked to the unlocked position.

6. The lock assembly of claim 3, wherein the inner spindle cam is coupled with the bolt locking arm by a bolt locking arm actuator extending in vertical direction of the lock body and a locking slider, said bolt locking arm actuator having a top end and a bottom end and being pivotally supported in the housing with the top end and coupled to the bolt locking arm between the top and bottom end, said locking slider being mounted on the bottom end and slidably supported in the housing for movement in a horizontal direction, wherein the rearward rotation of the inner spindle cam causes sliding of the locking slider in the direction of the front side of the housing, and corresponding pivoting of the bolt locking arm actuator in the direction of the front side of the housing and movement of the bolt locking arm from the locked position to the unlocked position.

7. The lock assembly of claim 1, further comprising means for adjusting a distance between the trigger plate and the locking plate at which the trigger plate engages the locking plate in response to engagement of the trigger plate with the door jamb.

8. The lock assembly of claim 7, wherein said means for adjusting a distance between the trigger plate and the locking plate includes a screw threaded into a corresponding threaded bore formed in the locking plate, the screw having a head positioned between the trigger plate and locking plate, and wherein the screw is adjustable in height to adjust the distance between the trigger plate and the door jamb.

9. The lock assembly of claim 7, wherein a resilient member is positioned between the base plate and locking plate to bias the locking plate at an upwardly angle with respect to the base plate.

10. The lock assembly of claim 1, further comprising a second deadbolt operatively coupled with a second actuator supported in the housing, said second deadbolt supported for linear movement between a retracted position and an extended position, said first and second deadbolts being coupled for simultaneous movement between their respective retracted and extended positions, and so coupled that movement of the second deadbolt from its retracted position to its extended position is blocked when the first deadbolt is held in its retracted position.

11. The lock assembly of claim 10, further comprising a third deadbolt operatively coupled with a third actuator supported in the housing, said third deadbolt supported for linear movement between a retracted and an extended position, said first, second and third deadbolts being coupled for simultaneous movement between their respective retracted and extended positions, and so coupled that movement of the second and third deadbolts from their respective retracted positions to their extended positions is blocked when the first deadbolt is held in its retracted position.

12. A lock assembly, comprising:

a lock body comprising a housing;

first and second deadbolts operatively coupled with respective first and second actuators supported in the housing, said first and second deadbolts supported for linear movement between respective retracted and extended positions and coupled for simultaneous movement between the respective retracted and extended positions and so coupled that movement of the second deadbolt from the retracted to the extended position is blocked when the first deadbolt is held in its retracted position;

a spring mounted in the housing and biasing the first deadbolt toward its extended position; and a trigger mechanism mounted on the door for engagement with a door jamb upon closure of the door, said trigger mechanism in direct contact with one of the second and first deadbolts and adapted to hold the one of the second and first deadbolts in the retracted position in opposition to a spring bias when the door is open, and to permit movement of the one of the second and first deadbolts to the extended position upon engagement of the trigger mechanism with the door jamb;

wherein the trigger mechanism includes:

a base plate and an upper plate connected in a spaced apart and parallel relation, a locking plate received between the base plate and the upper plate and pivotable between an upper position and a lower position, and a trigger plate positioned over the locking plate and configured to cause pivoting of the locking plate from the upper position to the lower position in response to engagement of the trigger plate with the door jamb, said base plate, upper plate, locking plate and trigger plate respectively provided with apertures which are aligned for slidingly receiving the one of the second and first deadbolts therethrough; wherein in the upper position of the locking plate, the one of the second and first deadbolts is held in the retracted position by engagement with an edge of the aperture of the locking plate; and in the lower position of the locking plate, movement of the one of the second and first deadbolts through the apertures from the retracted to the extended position is permitted.

13. The lock assembly of claim 12, further comprising a third deadbolt operatively coupled with a third actuator supported in the housing, said third deadbolt supported for linear movement between a retracted position and an extended position, said first, second and third deadbolts being coupled for simultaneous movement between their respective retracted and extended positions, and so coupled that movement of the second and third deadbolts from their respective retracted positions to their extended positions is blocked when the first deadbolt is held in its retracted position.

14. The lock assembly of claim 12, wherein the first, second and third deadbolts are coupled to each other by a gear member rotatably supported in the housing, wherein rotation of the gear member in a CW direction causes movement of the deadbolts from their respective extended positions to their retracted positions and CCW rotation of the gear member causes movement of the first, second and third deadbolts from their respective retracted positions to their extended positions.

15. The lock assembly of claim 12, further comprising means for adjusting a distance between the trigger plate and the locking plate at which the trigger plate engages the locking plate in response to engagement of the trigger plate with the door jamb.

16. The lock assembly of claim 15, wherein said means for adjusting a distance between the trigger plate and the locking plate includes a screw threaded into a corresponding threaded bore formed in the locking plate, the screw having a head positioned between the trigger plate and locking plate, and wherein the screw is adjustable in height to adjust the distance between the trigger plate and the door jamb.

17. The lock assembly of claim 12, wherein a resilient member is positioned between the base plate and locking plate to bias the locking plate at an upwardly angle with respect to the base plate.

18. A lock assembly for a door, comprising:

a lock body having a housing;

a first deadbolt operatively coupled with a first actuator supported in the housing, said first deadbolt supported for linear movement between a retracted position and an extended position and biased toward the extended position by a spring force of a spring mounted in the housing; and a trigger mechanism mounted on the door for engagement with a door jamb upon closing of the door, said trigger mechanism in direct contact with the first deadbolt and adapted to hold the first deadbolt in the retracted position when the door is open in opposition to said spring force, and to permit movement of the first deadbolt to the extended position upon contact of the trigger mechanism with the door jamb;

wherein the trigger mechanism includes a movable locking plate and a movable trigger plate which are arranged in an adjustable spaced-apart relation, the trigger plate being selectively adjustable to contact the door jamb and move the locking plate to a disengagement position which is orthogonal or substantially orthogonal to the first deadbolt, thereby enabling the linear movement of the first deadbolt to the extended position; and the trigger plate configured to movably disengage from the door jamb when the door is in an open state and further enable the locking plate to move to a locking position which is angled with respect to the first deadbolt so as to immediately lock the first deadbolt in the retracted position.

* * * * *